US009756965B2

(12) United States Patent
Isfort et al.

(10) Patent No.: US 9,756,965 B2
(45) Date of Patent: Sep. 12, 2017

(54) REFRIGERATOR

(71) Applicant: REMIS GESELLSCHAFT FUER ENTWICKLUNG UND VERTRIEB TECHNISCHER ELEMENTE MBH, Cologne (DE)

(72) Inventors: Paul Isfort, Cologne (DE); Simon Swiderski, Saarbruecken (DE)

(73) Assignee: REMIS GESELLSCHAFT FUER ENTWICKLUNG UND VERTRIEB TECHNISCHER ELEMENTE MBH, Cologne (DE)

( * ) Notice: Subject to any disclaimer, the term of this patent is extended or adjusted under 35 U.S.C. 154(b) by 20 days.

(21) Appl. No.: 14/413,707

(22) PCT Filed: Jul. 4, 2013

(86) PCT No.: PCT/EP2013/064130

§ 371 (c)(1),
(2) Date: May 21, 2015

(87) PCT Pub. No.: WO2014/009244

PCT Pub. Date: Jan. 16, 2014

(65) Prior Publication Data

US 2015/0245720 A1 Sep. 3, 2015

(30) Foreign Application Priority Data

Jul. 10, 2012 (DE) ..... 10 2012 106 200

(51) Int. Cl.
*A47F 3/04* (2006.01)
*F25D 23/02* (2006.01)

(52) U.S. Cl.
CPC ..... *A47F 3/04* (2013.01); *A47F 3/043* (2013.01); *A47F 3/0434* (2013.01); *F25D 23/028* (2013.01); *F25D 2400/18* (2013.01)

(58) Field of Classification Search
CPC ..... A47F 3/04; A47F 3/043; A47F 3/0434; A47F 3/0005; A47F 2003/008; F25D 23/028
(Continued)

(56) References Cited

U.S. PATENT DOCUMENTS 4,637,167 A 1/1987 Svensson
4,658,553 A 4/1987 Shinagawa
(Continued)

FOREIGN PATENT DOCUMENTS

DE 198 28 333 A1 12/1999
EP 0 138 782 A1 4/1985
(Continued)

*Primary Examiner* — James O Hansen
(74) *Attorney, Agent, or Firm* — Norman B. Thot

(57) ABSTRACT

A refrigerator for storing food includes a multiple-glazed refrigerator door which is configured to be pivotable or slidable, and an access opening which is configured to be closed by the multiple-glazed refrigerator door. The multiple-glazed refrigerator door comprises edge-side spacer elements, a transparent vertical edge, a vertical transparent spacer element comprising a transparent material arranged at the transparent vertical edge of the multiple-glazed refrigerator door, at least one of a horizontal frame element and a vertical frame element configured to have the multiple-glazed refrigerator door be mounted thereon, and at least two transparent glass panes which are spaced apart from each other via the edge-side spacer elements. The access opening is arranged in a vertical plane. No supporting vertical frame element is arranged at the transparent vertical edge of the multiple-glazed refrigerator door.

17 Claims, 4 Drawing Sheets

(58) Field of Classification Search
USPC ..... 312/114, 116, 138.1, 139.2, 405
See application file for complete search history.

(56) References Cited

U.S. PATENT DOCUMENTS

| | | | | |
|---|---|---|---|---|
| 4,660,903 | A | 4/1987 | Shinagawa | |
| 5,128,181 | A | 7/1992 | Kunert | |
| 6,435,630 | B1 * | 8/2002 | Anin | A47F 3/0434 312/116 |
| 2004/0214010 | A1 | 10/2004 | Murata et al. | |
| 2009/0021130 | A1 * | 1/2009 | Weiss | A47F 3/0434 312/405 |
| 2009/0087635 | A1 | 4/2009 | Yano | |
| 2010/0043293 | A1 | 2/2010 | Nicholson et al. | |
| 2015/0245720 | A1 | 9/2015 | Isfort et al. | |
| 2016/0120336 | A1 † | 5/2016 | Schneider | |

FOREIGN PATENT DOCUMENTS

| | | | |
|---|---|---|---|
| EP | 0138782 | * | 4/1985 |
| EP | 2 872 837 | A1 | 5/2015 |
| GB | 2 202 570 | A | 9/1988 |
| GB | 2 241 013 | A | 8/1991 |
| JP | 54-1242 | U | 1/1979 |
| JP | 56-91335 11 | | 7/1981 |
| JP | 57-60565 | U | 4/1982 |
| JP | 2-85987 | U | 7/1990 |
| JP | 2-132629 | U | 11/1990 |
| JP | 6-78582 | U | 11/1994 |
| JP | 2002-114542 | A | 4/2002 |
| WO | WO 2006/112340 | A1 | 10/2006 |
| WO | WO 2014/009244 | A1 | 1/2014 |
| WO | WO 2014/198549 | A1 | 12/2014 |

* cited by examiner
† cited by third party

REFRIGERATOR

CROSS REFERENCE TO PRIOR APPLICATIONS

This application is a U.S. National Phase application under 35 U.S.C. §371 of International Application No. PCT/EP2013/064130, filed on Jul. 4, 2013 and which claims benefit to German Patent Application No. 10 2012 106 200.5, filed on Jul. 10, 2012. The International Application was published in German on Jan. 16, 2014 as WO 2014/009244 A1 under PCT Article 21(2).

FIELD

The present invention relates to a refrigerator, in particular to a commercial refrigerator for storing food.

BACKGROUND

A refrigerator is a cooled cupboard which comprises its own refrigeration unit or is connected to a remote refrigeration unit. The refrigerator keeps the refrigeration room at temperatures below the room temperature in the vicinity of the refrigerator. The term refrigerator also includes so-cooled freezers in which frozen food is stored, for example, at a temperature of −18° C. and lower. The refrigerator comprises a vertically extending refrigeration room in which a plurality of shelves are arranged one upon the other.

The refrigerator comprises an access opening in a vertical plane which is adapted to be closed by a pivotable or slidable refrigerator door. The refrigerator door comprises multiple glazing which is made up of at least two spaced-apart transparent glass panes. The spacing between the two glass panes is adjusted by spacer elements arranged between the glass panes at the edges thereof. The two glass panes of a refrigerator door are further enclosed by frame elements which supportingly carry the glass panes and in which the refrigerator door is mounted.

Both the spacer elements and the frame elements are normally made up of metal sections which define a non-transparent door frame around the glass panes. This door frame obstructs the view of the refrigeration room and/or the food on the shelves from outside.

SUMMARY

An aspect of the present invention to provide a refrigerator offering a better view of its refrigeration room from outside.

In an embodiment, the present invention provides a refrigerator for storing food which includes a multiple-glazed refrigerator door configured to be pivotable or slidable, and an access opening arranged in a vertical plane. The access opening is configured to be closed by the multiple-glazed refrigerator door. The multiple-glazed refrigerator door comprises edge-side spacer elements, a vertical transparent spacer element comprising a transparent material arranged at a transparent vertical edge of the multiple-glazed refrigerator door, at least one of a horizontal frame element and a vertical frame element configured to have the multiple-glazed refrigerator door be mounted thereon, and at least two transparent glass panes. The at least two transparent glass panes are arranged so as to be spaced apart from each other via the edge-side spacer elements and to be enclosed at at least one of its edges by the at least one of a horizontal frame element and a vertical frame element. No vertical frame element is arranged at the transparent vertical edge of the multiple-glazed refrigerator door.

BRIEF DESCRIPTION OF THE DRAWINGS

The present invention is described in greater detail below on the basis of embodiments and of the drawings in which.

DETAILED DESCRIPTION

Figure 1:
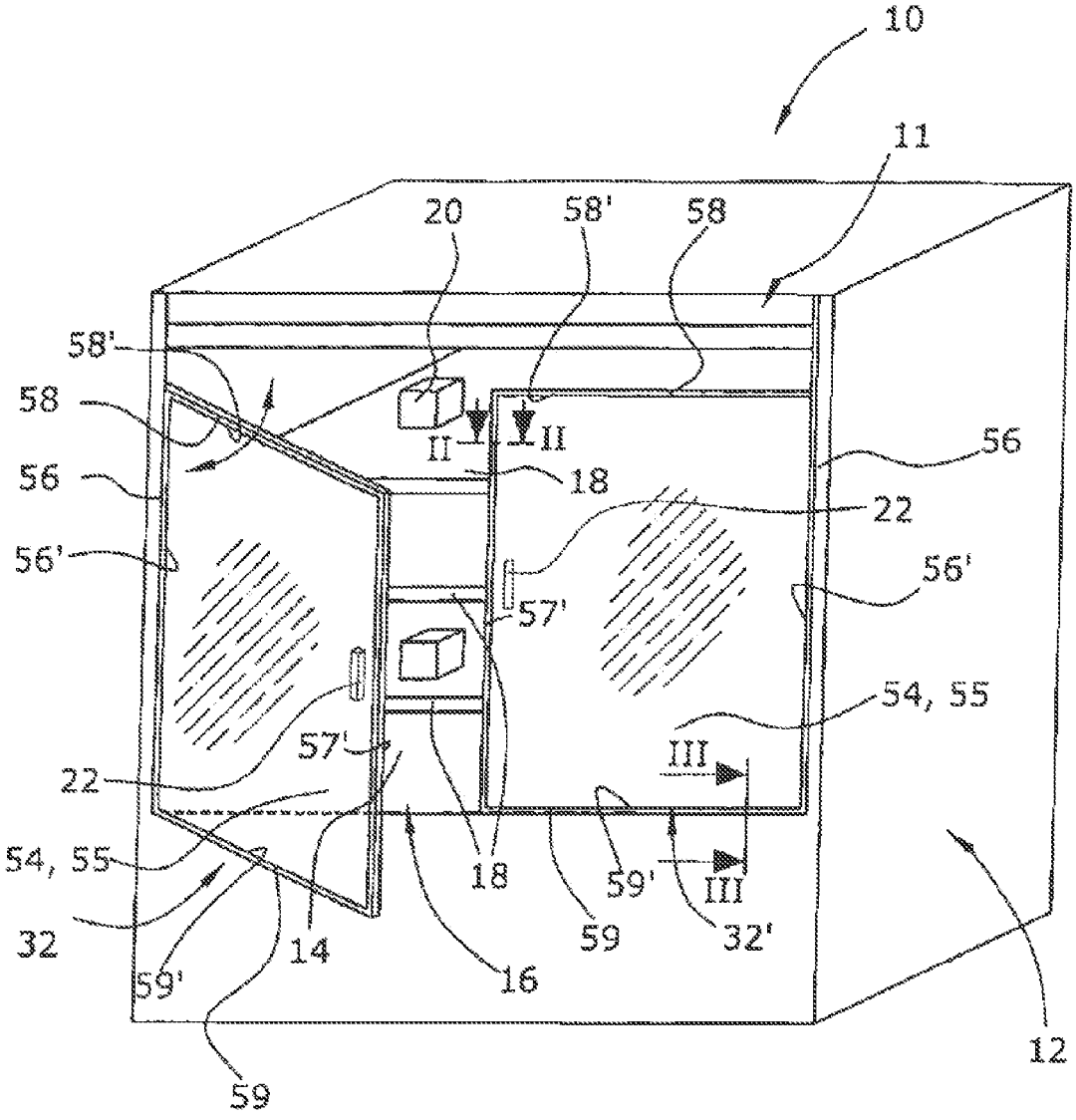
FIG. 1 shows a perspective view of a refrigerator having two refrigerator doors.

In an embodiment of the present invention, a vertical transparent spacer element made of a transparent material is provided on at least one transparent vertical edge of the refrigerator door, wherein no frame element enclosing the edges of the glass panes is provided at the transparent vertical edge. In the case of an access opening in which two or more refrigerator doors are arranged, the transparent vertical edge of the respective refrigerator door is the vertical edge of the closed refrigerator door located in the center of the access opening, namely, the vertical edge which may mainly obstruct the view of the refrigerator room from outside. The transparency of the transparent vertical edge is considerably improved since no supporting frame element is provided at the transparent vertical edge.

The vertical transparent spacer element connects the two glass panes and maintains the glass panes in a defined spaced relationship to each other. The transparent spacer element also seals the pane interspace between the two parallel glass panes towards the surroundings so that the gas in the glass pane interspace cannot escape and the air humidity from the surroundings cannot enter the interspace. The vertical transparent spacer element is not principly provided for supporting purposes, but rather for sealing purposes. This assembly allows a maximum transparency of the glass pane unit to be reached from all angles of view.

In an embodiment of the present invention, the vertical transparent spacer element can, for example, be made of silicone, PMMA, polycarbonate, or any other transparent thermoplastic material. The transparent spacer element can, for example, have a certain degree of elasticity to provide a continuous resting of the transparent spacer element on the whole surface of the adjacent glass pane to the greatest extent, even over an extended period of time and at shock loads.

Thermoplastic materials are plastic materials which are adapted to be deformed in a certain temperature range. Polycarbonate can, for example, be used to manufacture the vertical spacer element. Polycarbonate offers good heat insulation properties and remains transparent and fade-resistant over an extended period of time.

In an embodiment of the present invention, the edge compound between the transparent spacer element and the two glass panes can, for example, form a substance-to-substance connection. The spacer element and the glass panes can, for example, be glued to each other by an adhesive. This adhesive bond provides a mechanical bond and a gastight sealing. The adhesive can, for example, be acrylic-based since such adhesives offer good long-term properties with regard to their transparency, tightness, and adhesion.

The pane interspace between the glass panes can, for example, be closed in a gastight manner and essentially serves for heat insulation. The pane interspace can, for example, contain an insulating gas for heat insulation purposes. The insulating gas can, for example, be the noble gas argon. Since argon has a relatively large molecule size, argon cannot, or can only very slowly, diffuse through the transparent spacer element and/or the adhesive bond.

In an embodiment of the present invention, a separate sealant strip can, for example, be provided at a distal end of the spacer element which is made of a sealing compound. The sealing compound is located adjacent to the spacer element and closes the interspace between the two glass panes at the edges thereof. This may be reasonable and necessary since the spacer element adhesive is primarily designed for a strong mechanical bonding of the spacer element and the glass panes, but not necessarily as a sufficiently gastight barrier. The sealant strip in contrast does not need to provide strong holding forces for a reliable mechanical bonding of the two glass panes, but primarily serves as a sufficiently gastight closure of the glass pane interspace.

In an embodiment of the present invention, the sealing compound can, for example, be transparent. The sealing compound may be identical with the spacer element adhesive. The sealing compound is alternatively not identical with the spacer element adhesive and can, for example, be made of butyl rubber.

In an embodiment of the present invention, the refrigerator door can, for example, comprise separate frame elements at its lower and at its upper horizontal edge which encompass and enclose the respective front faces of the glass panes. The frame elements are non-transparent and are made of metal. The spacer elements associated with the respective frame elements may also be made of a non-transparent material which does not correspond to the material of the transparent spacer element.

Since the lower horizontal edge and the upper horizontal edge of a refrigerator door do not, or only slightly, obstruct the view of the refrigeration room, supporting components can be applied with a high strength, in particular to the two horizontal edges of the refrigerator door, which supporting components are, for example, made up of metal sections. The stability and the cohesion of the overall refrigerator door are provided by frame elements having a corresponding stability which are provided at the two horizontal edges of the refrigerator door. In an embodiment, the second vertical face of the refrigerator door, which is located opposite the transparent vertical face and which is arranged at the edge of the access opening when the refrigerator door is closed, may, for example, also be equipped with a separate frame element and a spacer element, wherein both the frame element and the spacer element may be non-transparent, namely, for example, made up of metal sections.

In an embodiment of the present invention, the spacer element can, for example, comprise an adhesive groove which is filled with the spacer element adhesive. The adhesive in the adhesive groove bonds the respective glass pane and the spacer element in a substance-to-substance manner and, to a large extent, in a gastight manner. The adhesive groove may have a round, an oval, a curved, or a rhombic cross-section. The adhesive groove essentially extends in the longitudinal direction of the transparent spacer element, namely, vertically along the overall length of the spacer element. Grooves for receiving sealing elements, sealing lips etc. may alternatively or additionally be provided.

In an embodiment of the present invention, the glass panes can, for example, be made of antireflective glass, for example, laminated safety glass. The coating provides for a low reflection of light as well as for good transparency and clarity. It is not, however, necessary that both glass panes be provided with an expensive antireflection coating. At least one glass pane can, for example, comprise an antireflection coating. The outer glass pane can, for example, comprise an antireflection coating on its inner face.

In an embodiment of the present invention, a shock protection strip can, for example, be provided at the transparent vertical edge which completely covers the front faces of the two glass panes. The shock protection strip can, for example, have an overall width of at least the sum of the two pane thicknesses and the spacing between the panes so that the shock protection strip completely covers the front faces of the glass panes and is, for example, flush with the outer faces of the two glass panes. The shock protection strip essentially serves to protect the front faces of the two glass panes at the transparent vertical edge against mechanical damage.

In an embodiment of the present invention, the shock protection strip can, for example, have a rectangular basic shape, but may also have a convex curvature at the front face facing away from the glass panes. This curvature of the shock protection strip improves the absorption of lateral shocks and provides increased damage prevention for the glass panes.

In an embodiment of the present invention, the transparent vertical element can, for example, be integrally formed with the shock protection strip and, together with the latter, defines a T-shaped section. Since the spacer element and the shock protection strip are integrally formed, the leakage path is considerably longer which results in an improved sealing of the glass pane interspace with regard to gas leakage from the glass pane interspace. An appearance with very few edges is further achieved. The section with a T-shaped cross-section also keeps the parallel glass panes at a defined position relative to each other already during assembly since the shock protection strip acts as a stopper for the front faces of the glass panes. The T-shaped section may, for example, be an extruded section.

Two exemplary embodiments of the present invention are hereinafter described in detail with reference to the drawings.

FIG. 1 shows a refrigerator 10 whose refrigeration room 14 is cooled to a temperature of above 0° C., for example, to +5° C. The present invention may also generally relate to a refrigerator 10 whose refrigeration room 14 is cooled to below 0° C., for example, to −18° C.

The refrigerator 10 comprises a refrigerator body 12 encasing the refrigeration room 14. In the refrigeration room 14, a plurality of shelves 18 accessible from the front are arranged one upon the other on which food 20 can be stored. The refrigerator body 12 comprises at its front face a large access opening 16 located in a vertical plane, which allows for access to the food 20. In the access opening 16, a door assembly 11 is located which essentially comprises two refrigerator doors 32, 32'. The refrigerator 10 has been retrofitted with the door assembly 11, i.e., the door assembly 11 has been subsequently mounted in the access opening 16 after installation of the refrigerator 10. The door assembly 11 may also be provided for the refrigerator 10 "ex works".

The access opening 16 is closed by two transparent refrigerator doors 32, 32' located in a single vertical plane when the refrigerator doors 32, 32' are in their closed position. The refrigerator doors 32, 32' are fastened at their edges to the refrigerator body 12 by means of joints rotatable about a vertical rotation axis.

The two refrigerator doors 32, 32' are double-glazed and therefore comprise two transparent glass panes 54, 55 each, wherein a handgrip 22 is fixed at the respective outer glass pane 54. The two glass panes 54, 55 of the refrigerator door 32, 32' are respectively framed by an upper horizontal frame element 58, a lower horizontal frame element 59, and a joint-side vertical frame element 56.

Each refrigerator door 32, 32' comprises an inner glass pane 55 and an outer glass pane 54. The two glass panes 54, 55 are spaced apart via spacer elements 56', 57', 58', 59' arranged at the edges. A pane interspace 62 is located between the two spaced-apart glass panes 54, 55. This pane interspace 62 between the two spaced-apart glass panes 54, 55 is filled with a heat-insulating argon insulating gas 82. The outer glass pane 54 comprises at its inner face an antireflection and/or heat-reflecting coating.

Figure 2:
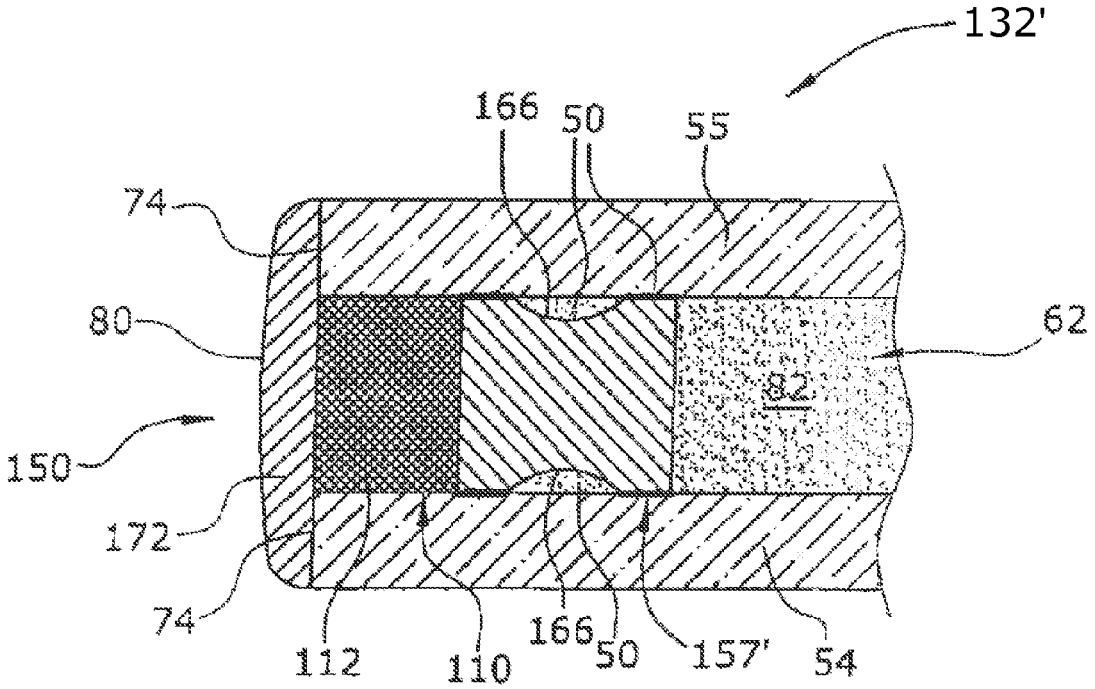
FIG. 2 shows a cross-sectional view of a first embodiment of the transparent vertical edge of a refrigerator door of the refrigerator of FIG. 1.

FIG. 2 shows a cross-sectional view of a first exemplary embodiment of the transparent vertical edge of a refrigerator door 132' of the refrigerator 10 of FIG. 1. At its side located in the center of the access opening 16, the refrigerator door 132' does not comprise any frame element enclosing the glass panes 54, 55 and/or in which the refrigerator door 132' is directly or indirectly mounted. The assembly 150 provided at the transparent vertical edge essentially serves to hermetically seal the pane interspace 62 between the two glass panes 54, 55. The assembly 150 is in particular not directly connected with the frame elements 56, 58, 59 which surround the other three sides of the glass panes 54, 55.

Between the two glass panes 54, 55, the transparent spacer element 157' is provided along the overall length of the transparent side edge. The transparent spacer element 157' is made of silicone, but it may also be made of PMMA or any other polycarbonate. The transparent spacer element 157' is elastic to a certain extent so that it closely fits to the surfaces of the adjacent glass panes 54, 55. The transparent spacer element 157' is not directly arranged at the edge of the glass panes 54, 55, but is displaced inwardly by a few millimeters. The transparent spacer element 157' is glued at both sides to the glass panes 54, 55 by an acrylic-based adhesive 50. The transparent spacer element 157' comprises a respective adhesive groove 166 to receive the adhesive 50 which extends in the longitudinal direction of the former, namely, in a spatially vertical direction, on both sides facing the glass panes 54, 55. The transparent spacer element 157' essentially provides an exact spacing between the two glass panes 54, 55.

A sealant strip 110 made of a sealing compound 112 is arranged at the distal end of the transparent spacer element 157'. The sealing compound 112 is made of butyl rubber but may also be made of any other suitable and, for example, transparent material. The sealant strip 110 serves above all for a gastight sealing of the pane interspace 62 so that leakage of the heat-insulating argon insulating gas 82 and the entery of air and humidity are prevented and/or minimized over several decades. The sealant strip 110 is approximately flush with the lateral front faces 74 of the two glass panes 54, 55.

The transparent vertical edge of the refrigerator door 132' comprises a terminating plastic shock protection strip 172 which completely covers the two front faces 74 and the sealant strip 110 and in particular serves to mechanically protect the two glass panes 54, 55 against damage. The front face 80 of the terminating plastic shock protection strip 172 has a slightly convex curvature.

Figure 3:
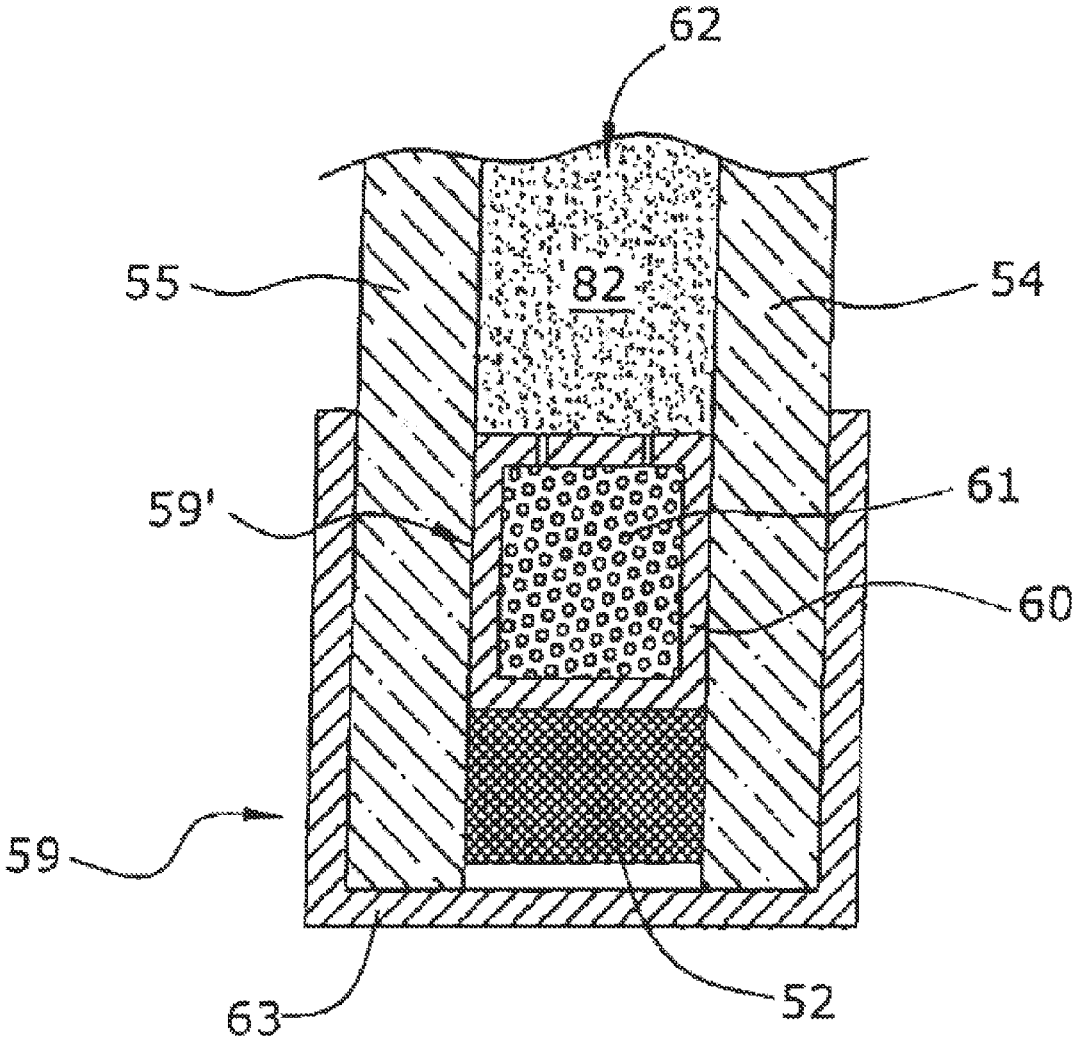
FIG. 3 shows a cross-sectional view of the lower horizontal edge of the refrigerator door.

FIG. 3 shows a cross-sectional view of the lower horizontal edge of the refrigerator door 32'; 132' whose configuration differs from that of the transparent vertical edge of the same refrigerator door 32'; 132'. A hollow metal section 60 is provided as a spacer element 59' which comprises a plurality of small openings towards the pane interspace 62. The spacer element 59' is filled with a desiccant 61 which serves to absorb humidity from the pane interspace 62. A sealant strip 52 made of butyl rubber or any other suitable sealant is arranged next to the spacer element 59'. The sealant strip 52 is approximately flush with the edges of the two glass panes 54, 55. A frame element 59 is further provided which is defined by a U-shaped frame element metal section 63 which completely surrounds and encloses the two glass panes 54, 55. The frame element metal section 63 is glued to the edges of the two glass panes 54, 55.

The upper horizontal edge as well as the joint-side vertical edge of the refrigerator door 32, 32' may be configured in the same way as the lower horizontal edge of the refrigerator door 32' as illustrated in FIG. 3. The three frame elements 56, 58, 59 are mechanically connected with each other, for example, being bolted and/or glued to each other. The three frame elements 56, 58, 59 are directly or indirectly fastened to the refrigerator body 12 by hinged joints.

Figure 4:
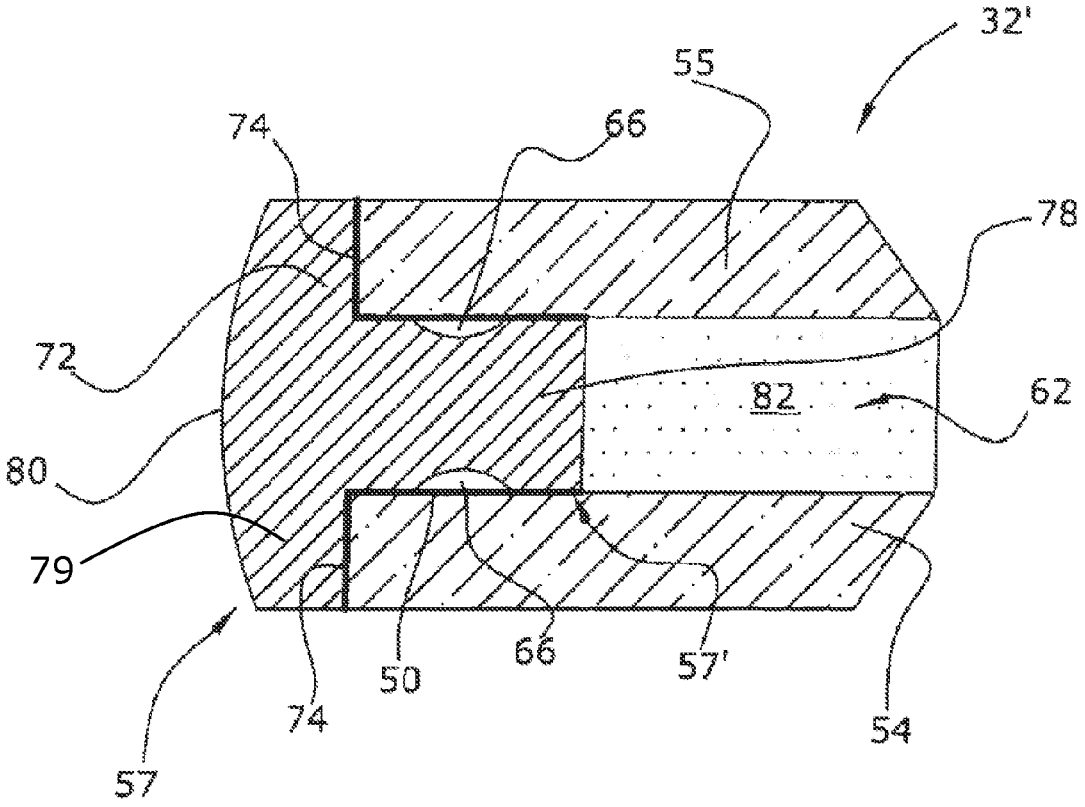
FIG. 4 shows a cross-sectional view of a second embodiment of the transparent vertical edge of the refrigerator door of the refrigerator of FIG. 1.

FIG. 4 shows a cross-sectional view of the transparent vertical edge facing away from the joint according to a second exemplary embodiment of the right refrigerator door 32' of the refrigerator 10. The spacer element 57' here forms part of an integral section body 57 with a T-shaped cross-section which is made up of a middle web 78 and a transverse web 79. The middle web 78 has a rectangular shape. The middle web 78 extends between the two glass panes 54, 55 which are located parallel and opposite to each other. The middle web 78 comprises an adhesive groove 66 with a round, oval, or rhombic shape at the two longitudinal horizontal legs. A suitable liquid adhesive is introduced into this adhesive groove 66 during manufacture of the refrigerator door 32, 32'. The transverse web 79 forms a shock protection strip 72 and rests on the lateral front faces 74 of the two glass panes 54, 55. The ratio of the length of the transverse web 79 to the length of the middle web 78 of the T-shaped section body is approximately 2:3. The side of the shock protection strip 72 facing away from the glass panes 54, 55 comprises a front face 80 having a slightly convex curvature.

The present invention is not limited to embodiments described herein; reference should be had to the appended claims.

What is claimed is:

1. A refrigerator for storing food, the refrigerator comprising:

a multiple-glazed refrigerator door configured to be pivotable or slidable, the multiple-glazed refrigerator door comprising:

at least two transparent glass panes;

edge-side spacer elements; and two horizontal frame elements and a vertical frame element which are configured to enclose the edge-side spacer elements and to have the multiple-glazed refrigerator door be mounted thereon, wherein, the at least two transparent glass panes are arranged so as to be spaced apart from each other via the edge-side spacer elements and to be enclosed by the two horizontal frame elements and the vertical frame element, at least one of the edge-side spacer elements is provided as a vertical transparent spacer element comprising a transparent material, the vertical transparent spacer element being arranged at a transparent vertical edge of the multiple-glazed refrigerator door which does not have a vertical frame element, and an access opening arranged in a vertical plane, the access opening being configured to be closed by the multiple-glazed refrigerator door.

2. The refrigerator as recited in claim 1, wherein the vertical transparent spacer element is glued to the at least two transparent glass panes.

3. The refrigerator as recited in claim 2, wherein the vertical transparent spacer element is glued to the at least two transparent glass panes via an acryl-based spacer element adhesive.

4. The refrigerator as recited in claim 3, further comprising a separate sealant strip comprising a sealing compound arranged at a distal end of the vertical transparent spacer element.

5. The refrigerator as recited in claim 4, wherein the sealing compound is transparent.

6. The refrigerator as recited in claim 4, wherein the sealing compound is the same as the acryl-based spacer element adhesive.

7. The refrigerator as recited in claim 4, wherein the sealing compound is not the same as the acryl-based spacer element adhesive.

8. The refrigerator as recited in claim 4, wherein, the sealing compound is not the same as the acryl-based spacer element adhesive, and the sealing compound comprises butyl rubber.

9. The refrigerator as recited in claim 3, wherein the vertical transparent spacer element comprises an adhesive groove configured to receive the acryl-based spacer element adhesive.

10. The refrigerator as recited in claim 1, wherein, the at least two transparent glass panes comprise a respective front face, and, the multiple-glazed refrigerator door comprises an upper horizontal frame element arranged at its upper horizontal edge and a lower horizontal frame element arranged at its lower horizontal edge as the two horizontal frame elements, the upper horizontal frame element and the lower horizontal frame element being configured to encompass the respective front faces of the at least two transparent glass panes.

11. The refrigerator as recited in claim 1, wherein the edge-side spacer elements are associated with the at least one of a horizontal frame element and a vertical frame element, the edge-side spacer elements being made of a non-transparent material which is different from that of the vertical transparent spacer element.

12. The refrigerator as recited in claim 1, further comprising a glass pane interspace arranged between the at least two transparent glass panes, the glass pane interspace being filled with an insulating gas.

13. The refrigerator as recited in claim 12, wherein the insulating gas is argon gas.

14. The refrigerator as recited in claim 1, wherein the vertical transparent spacer element comprises silicone, PMMA, or polycarbonate.

15. The refrigerator as recited in claim 1, wherein, the at least two transparent glass panes comprise a respective front face, and, further comprising a shock protection strip arranged at the transparent vertical edge so as to completely cover the respective front faces.

16. The refrigerator as recited in claim 15, wherein the vertical transparent spacer element is formed integrally with the shock protection strip and, together therewith, forms a T-shaped section.

17. The refrigerator as recited in claim 1, wherein the vertical transparent spacer element extends at least up to a respective edge of the two transparent glass panes at the transparent vertical edge of the multiple-glazed refrigerator door.

* * * * *